US009333399B2

(12) United States Patent
Llewellyn et al.

(10) Patent No.: US 9,333,399 B2
(45) Date of Patent: May 10, 2016

(54) ADJUSTABLE GOLF CLUB

(71) Applicant: Mizuno USA, Inc., Norcross, GA (US)

(72) Inventors: David Llewellyn, Duluth, GA (US); Tetsuya Kanayama, Osaka (JP)

(73) Assignee: Mizuno USA, Inc., Norcross, GA (US)

( * ) Notice: Subject to any disclaimer, the term of this patent is extended or adjusted under 35 U.S.C. 154(b) by 225 days.

(21) Appl. No.: 13/963,077

(22) Filed: Aug. 9, 2013

(65) Prior Publication Data

US 2014/0080617 A1 Mar. 20, 2014

Related U.S. Application Data

(60) Provisional application No. 61/681,208, filed on Aug. 9, 2012.

(51) Int. Cl.

| | |
|---|---|
| ***A63B 53/04*** | (2015.01) |
| ***A63B 53/06*** | (2015.01) |
| ***A63B 53/02*** | (2015.01) |
| *A63B 71/06* | (2006.01) |

(52) U.S. Cl.

CPC ..... *A63B 53/02* (2013.01); *A63B 53/0466* (2013.01); *A63B 53/06* (2013.01); *A63B 2053/025* (2013.01); *A63B 2053/026* (2013.01); *A63B 2053/0433* (2013.01); *A63B 2071/0694* (2013.01)

(58) Field of Classification Search

CPC ..... A63B 53/02; A63B 53/0466; A63B 2053/025; A63B 2071/0694; A63B 2053/026; A63B 2053/0433; A63B 53/06; A63B 2053/022; A63B 2053/023; A63B 2053/027; A63B 2053/028

USPC ..... 473/305–315, 244–248; 403/53, 59, 75, 403/101, 102

See application file for complete search history.

(56) References Cited

U.S. PATENT DOCUMENTS

| | | | | |
|---|---|---|---|---|
| 2,027,452 | A * | 1/1936 | Rusing | 473/246 |
| 2,155,830 | A * | 4/1939 | Howard | 473/246 |
| 2,882,053 | A * | 4/1959 | Lorthiois | A63B 53/06 473/245 |
| 3,423,089 | A * | 1/1969 | Andis | 473/245 |
| 4,174,108 | A * | 11/1979 | Reinholz | 473/247 |
| 4,506,888 | A * | 3/1985 | Nardozzi, Jr. | 473/307 |
| 7,438,645 | B2 * | 10/2008 | Hsu | A63B 53/02 473/246 |
| 8,403,770 | B1 * | 3/2013 | Aguinaldo | A63B 53/02 473/246 |
| 8,574,092 | B2 * | 11/2013 | Galloway | A63B 53/02 473/244 |
| 2009/0062029 | A1 * | 3/2009 | Stites et al. | 473/288 |
| 2013/0288816 | A1 * | 10/2013 | Nakamura | A63B 53/02 473/309 |

* cited by examiner

*Primary Examiner* — Sebastiano Passaniti

(74) *Attorney, Agent, or Firm* — Troutman Sanders LLP; James E. Schutz; Daniel T. Sharpe

(57) ABSTRACT

An adjustable golf club is disclosed. The club can be adjusted by moving one or more sliders located proximate the heel of the club. The sliders can move to enable the loft and lie of the club to be adjusted independently. To adjust the club, a user can loosen a fastener, reposition the sliders, and re-tighten the fastener. The one or more sliders can slide against a spherical surface with its origin at the center of rotation of the shaft. In this configuration, when the sliders are pressed against the spherical surface, the spherical surface can enable the club to remain properly adjusted.

20 Claims, 11 Drawing Sheets

5

6

7

8

ADJUSTABLE GOLF CLUB

CROSS-REFERENCE TO RELATED APPLICATION

This application claims priority under 35 U.S.C. §119(e) to U.S. Provisional Patent Application Ser. No. 61/681,208, filed 9 Aug. 2012, the entire contents and substance of which are hereby incorporated by reference as if fully set forth below.

BACKGROUND OF THE INVENTION

1. Field of the Invention

The present invention relates generally to golf clubs, and more particularly to adjustable golf clubs.

2. Background of Related Art

A variety of golf clubs exist. In the game of golf, a player swings clubs to strike and propel a ball towards, and eventually into, a hole. The object of the game is to hit the ball into a series of holes, generally eighteen holes, using as few swings, or strokes, as possible.

Golfers have many different swing types. This variety in swing types means that different golfers contact the ball in different ways. Some golfers may contact the ball, for example, while the club face is moving from left to right across the ball. Other golfers may contact the ball while the club face is moving from right to left, up to down, down to up, or various combinations thereof. In addition, some golfers rotate the club face such that it is angled toward the golfer ("closed") or away from the golfer ("open"). Each of these different swings can impart a different spin and/or flight trajectory to the ball. The ball may "slice" or "hook," for example, based on the type of swing the golfer uses. These trajectories can be desirable when intended and undesirable when unintended.

Golfers' strokes also tend to change over time. A golfer who previously contacted the ball with the club-face moving from left to right, for example, may modify his swing or stance so that he contacts the ball with the club face moving from right to left. This can have a significant effect on the trajectory of the ball. Again, this can be a desirable effect if the results are intended or an undesirable effect if the results are unintended.

In addition to a golfer's swing, the physical specifications, or inherent characteristics of the club head may also influence trajectory. Three influential characteristics are loft angle, lie angle, and face angle. Since golfers have a wide array of body and swing types, each of these angles should be adjustable to an appropriate value for the desired ball trajectory for each golfer. As shown in FIG. 1*a*, the loft is the angle between the club face and a vertical line, i.e., the angle of the club face from vertical. As shown in FIG. 1*b*, the lie is the angle between the hosel axis and the ground plane. As shown in FIG. 1*c*, the face angle is the angle between the club face and a line perpendicular to the target line. Thus, a club with a larger loft angle will cause the ball to have a higher trajectory, but travel a shorter distance. A club with a more upright lie yields a club face that tilts further upward towards the golfer. Finally, a club with a closed face angle is closed to the target (aimed left of the target for a right handed golfer), while an open face angle yields a club face that is open to the target (aimed right of the target for a right handed golfer).

Traditional golf clubs have predetermined loft, lie, and face angles that are not easily adjustable. Thus, the clubs cannot be easily modified to compensate for issues with a golfer's swing, such as unintended "hook" or "slice," for example.

The clubs also cannot be easily modified to compensate for changes in a golfer's swing. While traditional clubs can be altered slightly, this requires bending the hosel and/or the heel of the club. Such an adjustment requires expensive, precise equipment that must be operated by a trained professional. Moreover, such an adjustment should only be done a few times with each club, as repeated bending can cause metal fatigue, which can lead to failure.

Some adjustable golf clubs are known, however. These clubs can be modified to attempt to compensate for errors or changes in a golfer's swing. For example, as shown in FIG. 2, some clubs have a shaft that is slightly offset from the hosel, i.e., the center axis of the shaft and the center axis of the hosel are not aligned. To adjust the club, the shaft can be rotated with respect to the hosel, which causes the club head and the shaft to change position with respect to one-another. This type of club design, known as a "1-axis of rotation" design, has several disadvantages.

The principal disadvantage is that all three angles discussed above—loft, lie, and face angle—are adjusted at the same time, i.e., none of the angles can be adjusted separately. Moreover, in order to adjust the club, the shaft must be rotated, which rotates the grip. This can be problematic because golfers often use markings on the grip to ensure that their hands are in the proper position with respect to the club head. Many golfers also use asymmetrical grips that should be properly aligned with respect to the club head. When the shaft rotates relative to the club head, therefore, a grip that was properly positioned can become skewed, which can make it difficult for the golfer to properly grip the club and effectively strike the ball.

Additionally, some adjustable clubs require the use of a chart to determine the loft, lie, and face angle that the club is adjusted to. For example, some adjustable clubs have letters and/or numbers printed on their moveable components. To determine the loft, lie, and face angle of these clubs, a golfer must take note of certain letters and/or numbers, and reference a chart that provides the corresponding loft, lie, and face angles. These designs can be inconvenient for the golfer, however, as he or she must take time to review the chart, and must also carry the chart with him or her on the golf course.

What is needed, therefore, is an adjustable golf club that allows one or more of loft, lie, and face angle to be adjusted separately from the other two angles. The club should also be adjustable without requiring the shaft to rotate relative to the club head. Additionally, adjustments should be intuitive to the golfer, and should not require the use of a chart to explain the various settings. It is to such a golf club that embodiments of the present invention are primarily directed.

BRIEF SUMMARY OF THE INVENTION

Embodiments of the present invention relate to an adjustable golf club. In some embodiments, the club can be adjusted by moving sliders located proximate the heel of the club. To adjust the club, a user can loosen a fastener, reposition the sliders, and tighten the fastener to rigidly lock the club in place. This configuration can enable the lie and loft of the club to be adjusted independently.

To enable the sliders to be properly positioned, they can slide against a spherical mating surface or rim. The spherical surface can have its origin at the center of rotation of the shaft. In this configuration, when the sliders are pressed against the spherical surface, they exert a force that is directed axially, toward the origin of the sphere, regardless of the sliders' orientation. Unlike flat mating surfaces, therefore, this prevents the force exerted by the sliders on the surface from misaligning or "unadjusting" the club.

In some embodiments, the club can comprise a head with a cavity in the hosel. The cavity can be configured to receive an adaptor that has an upper portion and a lower portion. The upper portion of the adaptor can receive the shaft of the golf club. The lower portion of the adaptor can be detachably coupled to the head with a mechanical fastener. The mechanical fastener can also couple to and/or engage one or more sliders.

In some embodiments, a first slider can be disposed against a rim of the cavity such that the first slider can slide in a first direction. A second slider can be disposed against a bottom portion of the first slider such that the second slider can slide in a second direction that can be perpendicular to the first direction. The rim of the cavity can comprise the spherical surface. In this configuration, when the sliders move, they can enable the shaft of the golf club to pivot relative to the head. In this fashion, the golf club can be adjusted.

Embodiments of the present invention present several advantages over known adjustable golf clubs. As mentioned above, for example, lie and loft can be adjusted independently rather than being coupled together. Moreover, the club can be adjusted without misaligning the grip relative to the head of the club. Additionally, in some embodiments, the golf club can be infinitely adjustable. In other embodiments, the adjustability of the golf club can be stepwise, or finite.

Embodiments of the present invention can comprise an adjustable golf club comprising a club head, a shaft, and one or more sliders moveable to adjust the orientation of the club head with respect to the shaft. In some embodiments, the golf club can comprise two sliders that can be moveable to independently adjust the lie and loft of the golf club. In some embodiments, the golf club can comprise two sliders that can be constrained to move in substantially orthogonal directions. In some embodiments, moving a first slider in a first direction can adjust the lie of the golf club and moving a second slider in a second direction can adjust the loft of the golf club. In some embodiments, the first direction can be substantially orthogonal to the second direction. In some embodiments, the sliders can be constrained by ribs and grooves.

In some embodiments, a substantially spherical rim can be engaged by a first slider of the one or more sliders. In some embodiments, the shaft can pivot about the origin of the substantially spherical rim. In some embodiments, the first slider can comprise a top surface that is substantially spherically shaped.

In some embodiments, the golf club can further comprise an adaptor that can engage the shaft and the club head. In some embodiments, the adaptor can be configured to pivot when the orientation of the club head with respect to the shaft is adjusted. In some embodiments, the adaptor can be at least partially disposed within a cavity of the club head. In some embodiments, the adaptor can comprise one or more protrusions and the club head can comprise one or more depressions, and at least one protrusion can be configured to engage at least one depression to prevent the shaft from rotating relative to the club head. In some embodiments, a mechanical fastener can engage the adaptor and a first slider of the one or more sliders. In some embodiments, the mechanical fastener can be loosened to enable movement of the first slider and the mechanical fastener can be tightened to prevent the first slider from moving.

In some embodiments, the adjustability of the orientation of the club head with respect to the shaft can be limited to a discrete number of orientations. In some embodiments, the golf club can further comprise lie indicators, loft indicators, and pointers configured such that the pointers can point to the lie indicators and loft indicators to indicate the adjustment of the golf club.

Embodiments of the present invention can comprise an adjustable golf club comprising a club head and a shaft. The golf club can further comprise a first slider constrained to move in a first direction and a second slider constrained to move in a second direction. In some embodiments, the first direction can be substantially orthogonal to the second direction. In some embodiments, the first and second sliders can be in mechanical communication with the club head and the shaft to adjust the lie and loft of the golf club.

In some embodiments, moving the first slider in the first direction can adjust the lie of the golf club and moving the second slider in the second direction can adjust the loft of the golf club. In some embodiments, the lie and loft of the golf club can be adjusted independently.

Embodiments of the present invention can further comprise a method of adjusting a golf club having a club head and a shaft. In some embodiments, the method can comprise loosening a fastener to enable a slider to be moved from a first position to a second position. In some embodiments, the method can further comprise moving the slider from the first position to the second position to adjust the orientation of the club head with respect to the shaft. In some embodiments, the method can further comprise tightening the fastener. In some embodiments, the method can also comprise referencing a lie indicator and a loft indicator to determine the adjustment of the golf club.

These and other objects, features, and advantages of the present invention will become more apparent upon reading the following specification in conjunction with the accompanying drawing figures.

DETAILED DESCRIPTION OF THE INVENTION

Figure 1A:
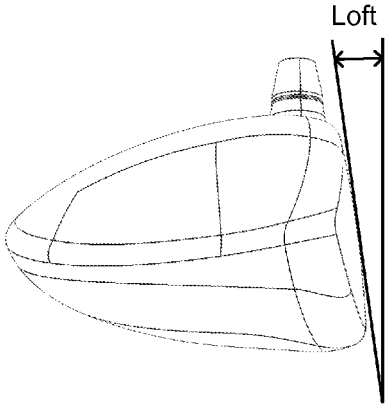
FIGS. 1*a*-1*c* illustrate loft, lie, and face angle of a golf club, respectively.
Figure 1B:
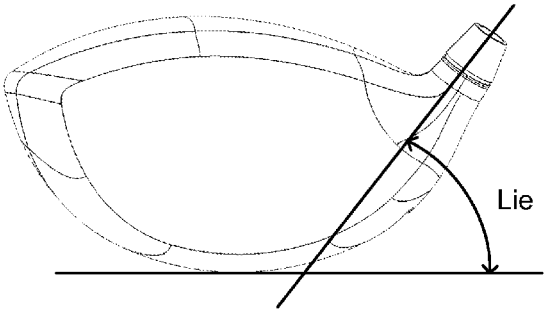
Figure 1C:
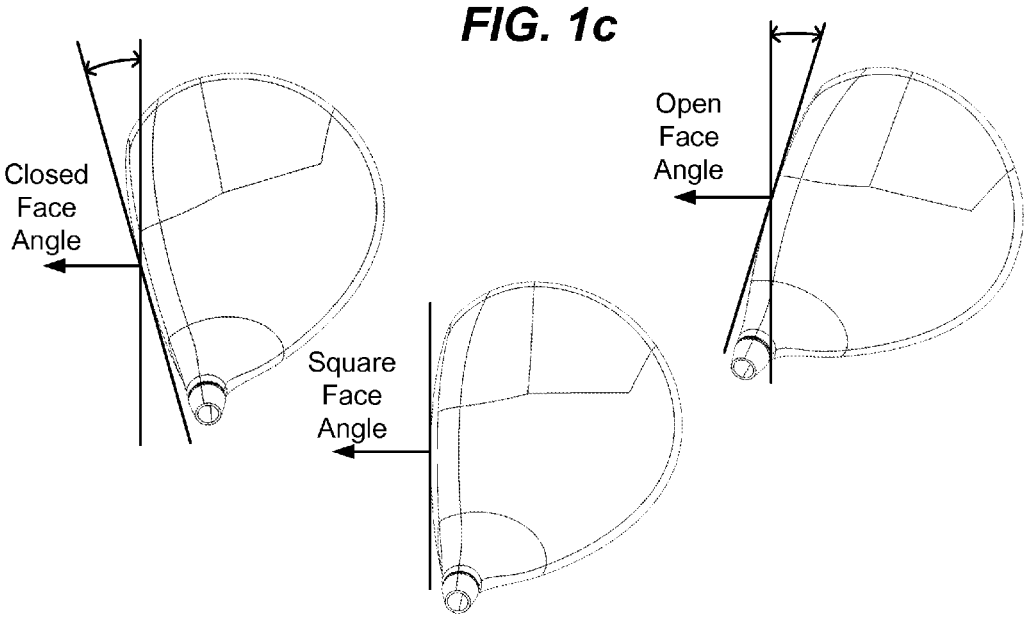
Figure 2:
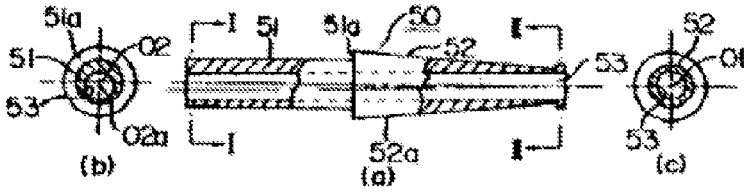
Fig. 2 Prior Art
FIG. 2 depicts a "1-axis of rotation" adjustable golf club.
Figure 2:
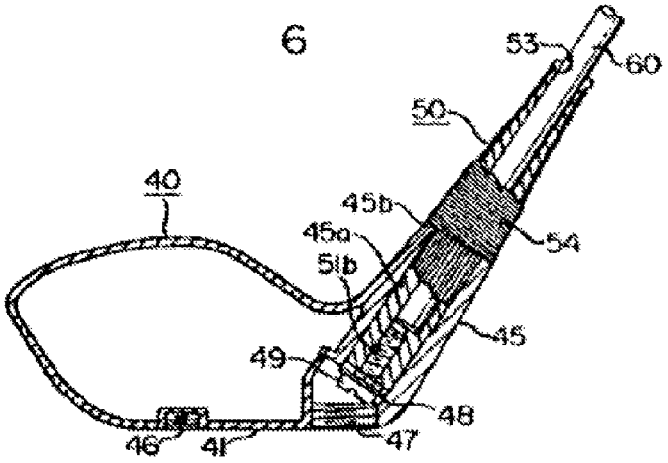
Fig. 2 Prior Art
Figure 2:
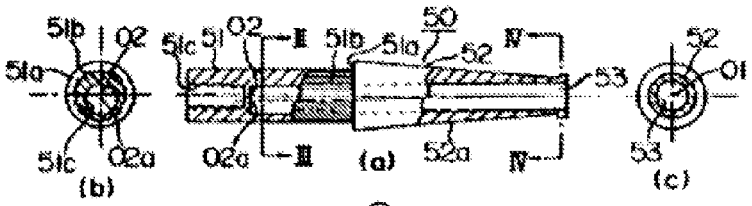
Fig. 2 Prior Art

Embodiments of the present invention relate generally to golf clubs, and more particularly to adjustable golf clubs. In some embodiments, a golf club can be adjusted by moving sliders located proximate the heel of the club head. The sliders can be in communication with the shaft of the club, enabling the sliders to reposition the shaft with respect to the club head, which enables adjustment of the club. In some embodiments, a user can loosen a fastener, reposition the sliders, and tighten the fastener to rigidly lock the club in place. In this manner, the user can adjust the club.

Embodiments of the present invention can comprise a cavity with a substantially spherical surface on which the one or more sliders can slide. The spherical surface can have its origin at the center of rotation of the shaft, i.e., the point about which the shaft pivots when being adjusted. The spherical shape of the surface can enable the force applied by the sliders to be normal, or axial, to the surface. This can reduce or eliminate the tendency of the fastener to cause the sliders to become misaligned or improperly positioned when tightened, which, in turn, prevents misalignment or improper positioning of the shaft and the club head.

To simplify and clarify explanation, the invention is described herein as an adjustable golf club. One skilled in the art will recognize, however, that the invention is not so limited. The invention can be used, for example and not limitation, with hockey sticks, lacrosse sticks, and other types of sporting equipment. The invention can also be used in non-athletic equipment, such as in various types of adjustable nozzles.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional adjustable golf clubs is that the loft, lie, and face angle cannot be adjusted independently. This can be due to a "1-axis of rotation" design, for example, that restricts the club to one value of each angle (e.g., loft) for a given value of the other angles (e.g., lie and face angle). This can restrict the ability of a golfer to adjust the clubs as necessary, which can restrict the golfer's ability to set the correct values of loft, lie, and face angle for his or her particular swing type in a straight forward, intuitive manner.

As shown in FIGS. 3-10*b*, the present invention can comprise an adjustable golf club. More specifically, the present invention can comprise an adjustable golf club that enables a user to adjust the loft and lie independently. Moreover, the adjustable golf club can be adjusted without requiring rotation of the shaft, thereby preventing, for example, the markings on the grip, or an asymmetrical grip, from becoming misaligned with the club head. The adjustable club can also comprise a means for providing finite or infinite adjustment depending on, for example, the applicable golf rules.

Figure 3:
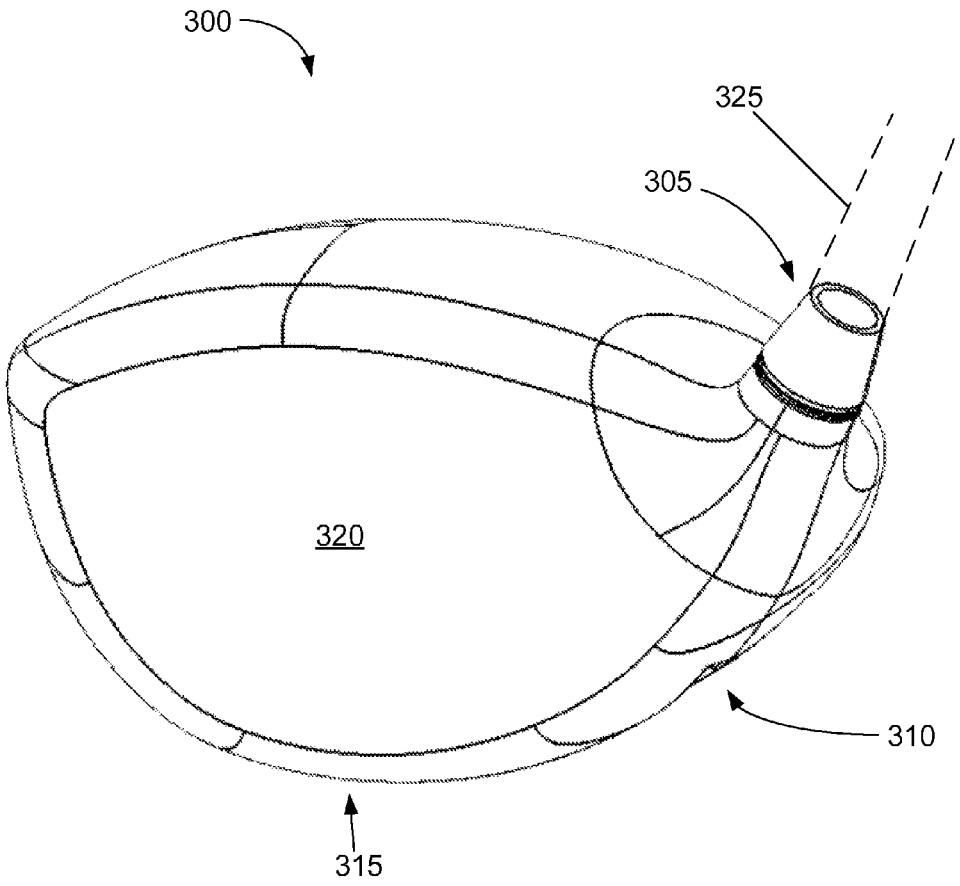
FIG. 3 depicts a golf club head, in accordance with some embodiments of the present invention.

In some embodiments, as shown in FIG. 3, the adjustable golf club can comprise a golf club head 300. The head 300 can comprise a hosel 305, heel 310, sole 315, and club face 320. To adjust the club, the head 300, and thus the club face 320, can pivot with respect to a shaft 325, or similarly, the shaft 325 can pivot with respect to the head 300. This can adjust the orientation of the club head 300 with respect to the shaft 325 (or equivalently, adjust the orientation of the shaft 325 with respect to the club head 300). For illustration, the shaft 325 is shown in dashed lines. Unlike known adjustable clubs, embodiments of the present invention enable the head 300 to be pivoted so that the lie and loft can be adjusted independently.

Figure 4:
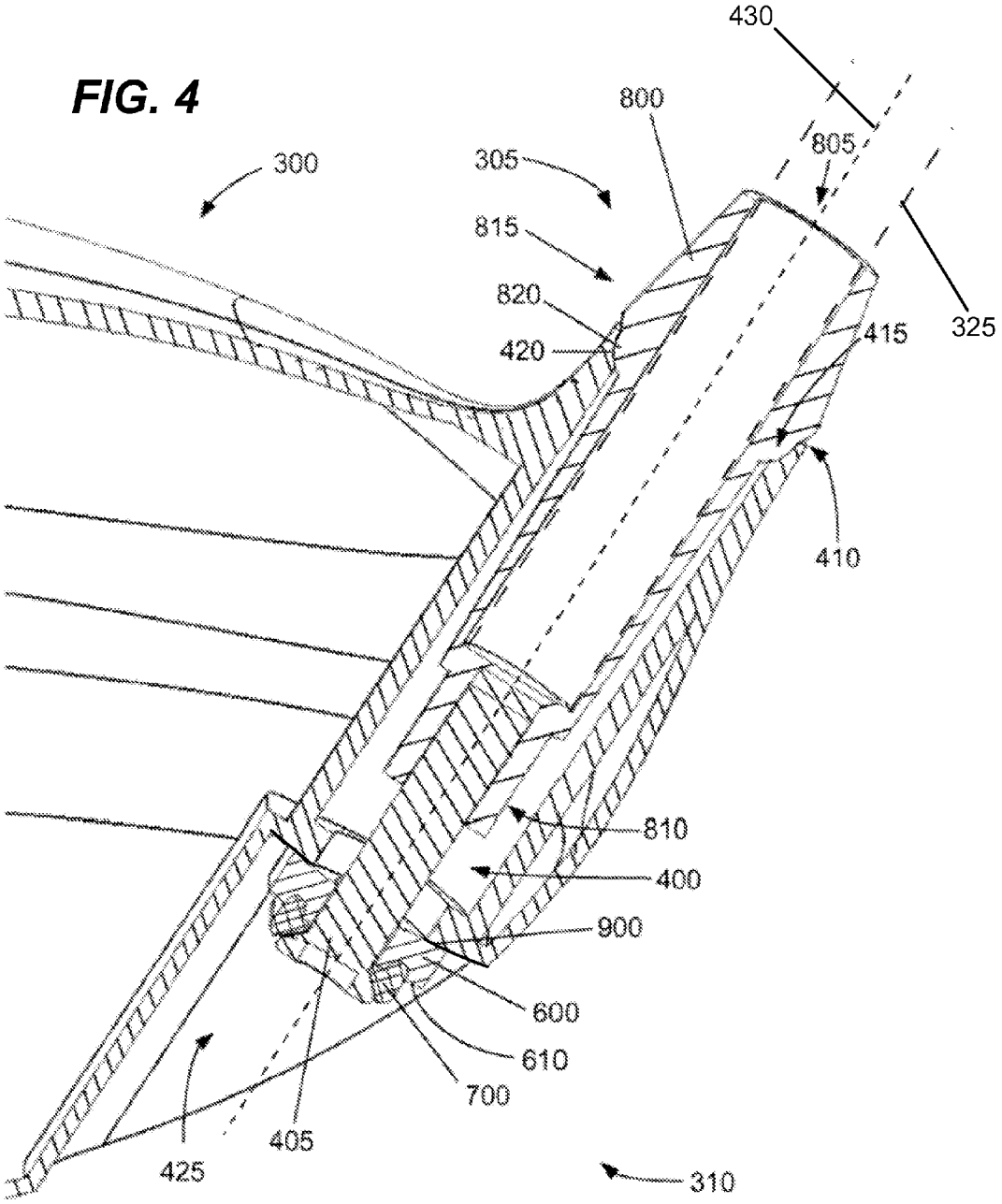
FIG. 4 depicts a cross-section of an adjustable golf club, in accordance with some embodiments of the present invention.

FIG. 4 is a cross-section of a portion of a golf club in accordance with some embodiments of the present invention. As shown in FIG. 4, independent adjustment of lie and loft can be achieved with one or more sliders 600, 700. The sliders 600, 700 can be in communication with the shaft 325 via a fastener 405 and an adaptor 800, and movement of the sliders 600, 700 can therefore cause the shaft 325 to pivot with respect to the club head 300 to adjust the orientation of the club head 300 with respect to the shaft 325. Embodiments of the present invention enable the shaft 325 to be pivoted to adjust loft only, lie only, or both loft and lie.

In some embodiments, a first slider 600 can be located against a spherical rim 900 at the bottom of a cavity 400 in the hosel 305. Additionally, a second slider 700 can be disposed against the bottom surface 610 of the first slider 600. Each of the sliders 600, 700 can be configured to move laterally along an axis or in a given plane. In some embodiments, for example, the first slider 600 can move in a Y-direction that runs substantially parallel to the club face 320 (and substantially parallel to the plane of the cross-section shown in FIG. 4). Additionally, in some embodiments, the second slider 700 can move in an X-direction that that runs substantially perpendicular to the Y-direction (and substantially parallel to a plane extending out of FIG. 4). This configuration can provide for adjustability of the golf club. More specifically, a user can move and adjust the sliders 600, 700 in the X and Y-directions, causing the shaft 325 to move. The movement of the shaft 325 changes its orientation with respect to the club head 300, thereby adjusting the club.

In some embodiments, as discussed above, one slider 600 can move in the Y-direction and another slider 700 can move in the X-direction. This configuration can enable lie to be adjusted independently from loft. Adjusting the first slider 600 in the Y-direction, for example, can cause the angle between the hosel axis 430 and the ground plane to vary, modifying lie without affecting loft. Adjusting the second slider 700 in the X-direction, on the other hand, can cause the angle between the club face 320 and a vertical line to vary, modifying loft without affecting lie. The substantially orthogonal movement of the sliders 600, 700 therefore enables lie and loft to be adjusted independently. This design also does not require rotation of the shaft 325 during adjustment, and therefore does not cause the grip to become misaligned with the club head 300.

Figures 5A, 5B:
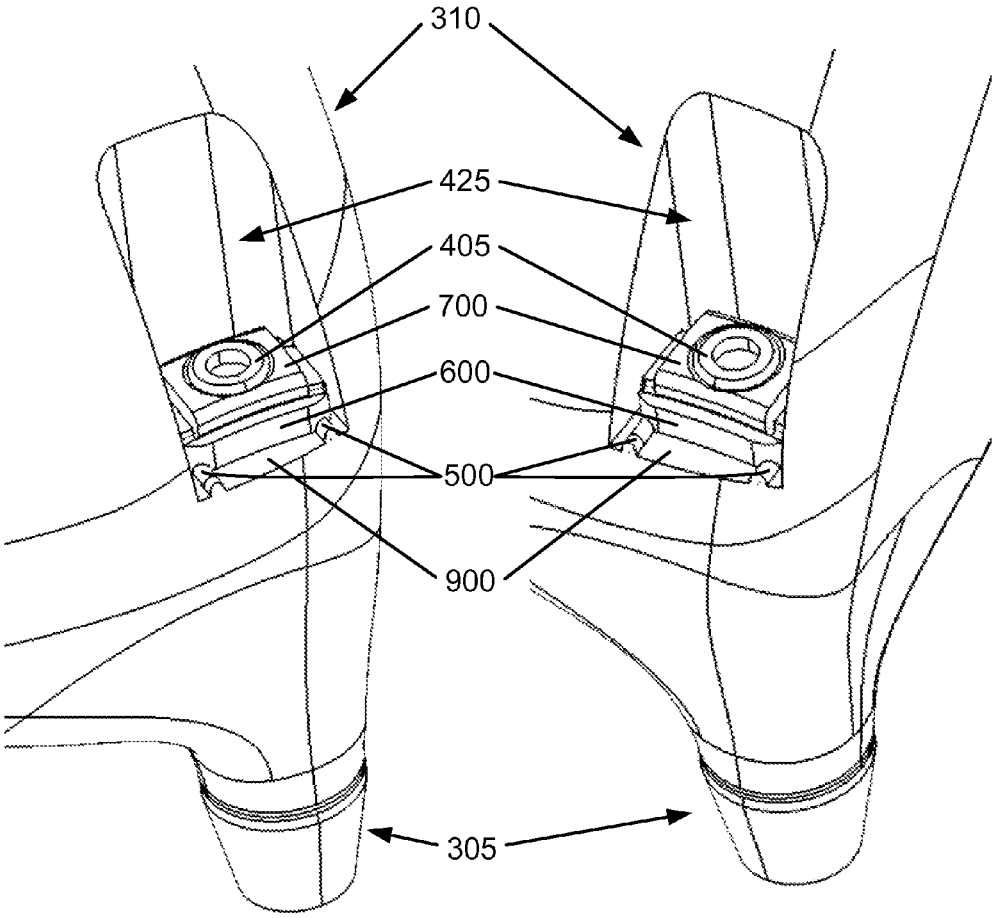
FIGS. 5*a*-5*b* depict bottom perspective views of an adjustable golf club, in accordance with some embodiments of the present invention.
Figure 6A:
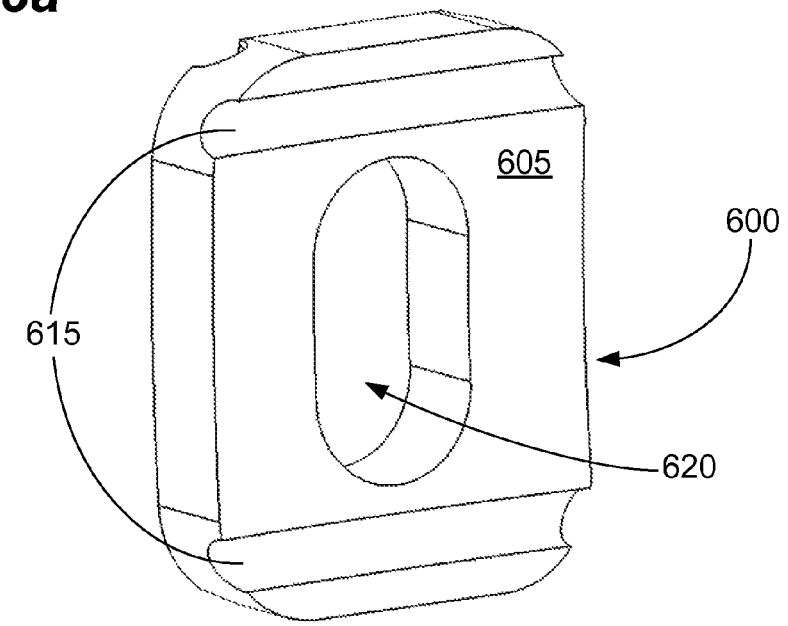
FIGS. 6*a*-6*b* depict a first slider for use with an adjustable golf club, in accordance with some embodiments of the present invention.
Figure 6B:
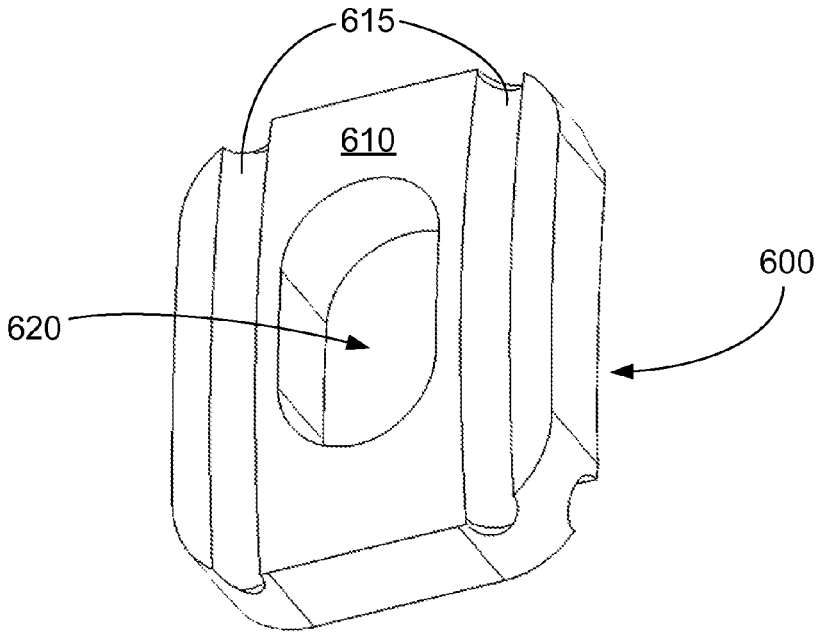
Figure 7A:
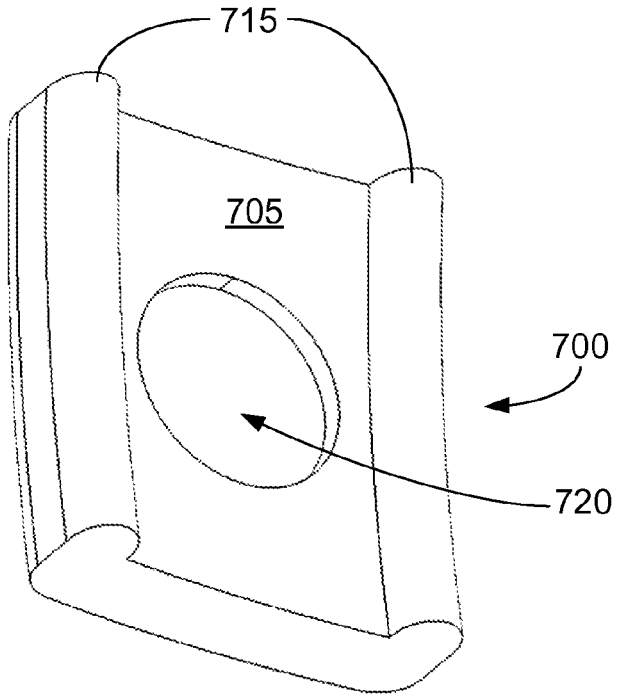
FIGS. 7*a*-7*b* depict a second slider for use with an adjustable golf club, in accordance with some embodiments of the present invention.
Figure 7B:
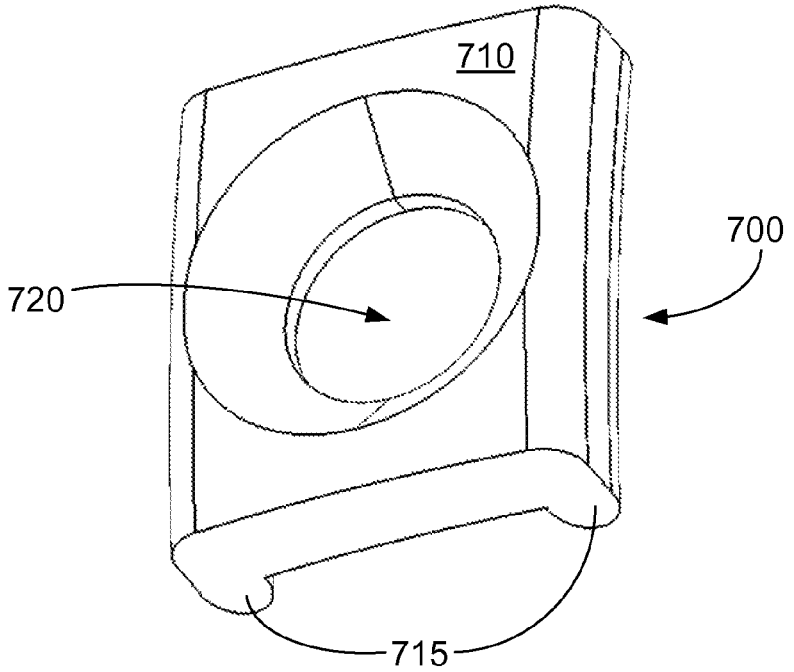

In some embodiments, as shown in FIGS. 5*a*-5*b*, each slider 600, 700 can be restricted to movement in substantially one direction, i.e., each slider 600, 700 can be substantially restricted to lateral movement in the X-direction or Y-direction. This can prevent the sliders 600, 700 from rotating out of orientation. As shown, in some embodiments, to restrict movement of the sliders 600, 700, the lower lip of the rim 900 of the cavity 400 can comprise one or more ribs 500. Moreover, as shown in FIGS. 6*a*-6*b*, the top surface 605 of the first slider 600 can comprise one or more grooves 615. The grooves 615 of the top surface 605 can be adapted to receive the ribs 500 such that, when the first slider 600 is held against the rim 900 of the cavity 400, the grooves 615 can receive the ribs 500 and slide over the ribs 500. Thus, the substantially spherical rim 900 can engage the slider 600, and the slider 600 can engage the substantially spherical rim 900. The ribs 500 and grooves 615 can therefore constrain the first slider 600 to movement in substantially one direction, i.e., the Y-direction.

Similarly, as shown in FIGS. 5*a*-7*b*, in some embodiments, the second slider 700 can be constrained to movement in substantially one direction relative to the first slider 600. To constrain the second slider 700, for example, the top surface 705 of the second slider 700 can comprise one or more ribs 715, and bottom surface 610 of the first slider 600 can comprise one or more grooves 615. The grooves 615 can be adapted to receive the ribs 715 such that, when the second slider 700 is held against the bottom surface 610 of the first slider 600, the ribs 715 can slide within the grooves 615. Thus, the first slider 600 can engage the second slider 700, and the second slider 700 can engage the first slider 600. The ribs and grooves 615 can therefore constrain the second slider 700 to movement in one direction relative to the first slider 600, i.e., the X-direction.

As described above, in some embodiments, the first slider 600 can move in the Y-direction, and the second slider 700 can move in the X-direction, allowing for independent adjustment of loft and lie. In other embodiments, however, the first slider 600 can move in the X-direction, and the second slider 700 can in the Y-direction. This configuration can also allow for independent adjustment of loft and lie. In addition, in some embodiments, the axes can be aligned in other orientations, i.e., the axes are not necessarily parallel to the X and Y-directions. In some embodiments, the positions of the ribs 500 and grooves 615 on the rim 900 and sliders 600, 700 can be reversed.

Importantly, in some embodiments, the rib 500, 715 and groove 615 arrangement described above can also prevent the sliders 600, 700 from rotating out of orientation. If allowed to rotate, each slider 600, 700 could move in multiple directions, making repeatable adjustment of the club difficult, if not impossible. Because the ribs 500, 715 can engage the grooves 615 along their length, however, the ribs 500 on the lower lip of the rim 900 can engage the grooves 615 on the top surface 605 of the first slider 600 to prevent the first slider 600 from rotating. Similarly, the ribs 715 on the top surface 705 of the second slider 700 can engage the grooves 615 on the bottom surface 610 of the first slider 600 to prevent the second slider 700 from rotating.

Figure 9:
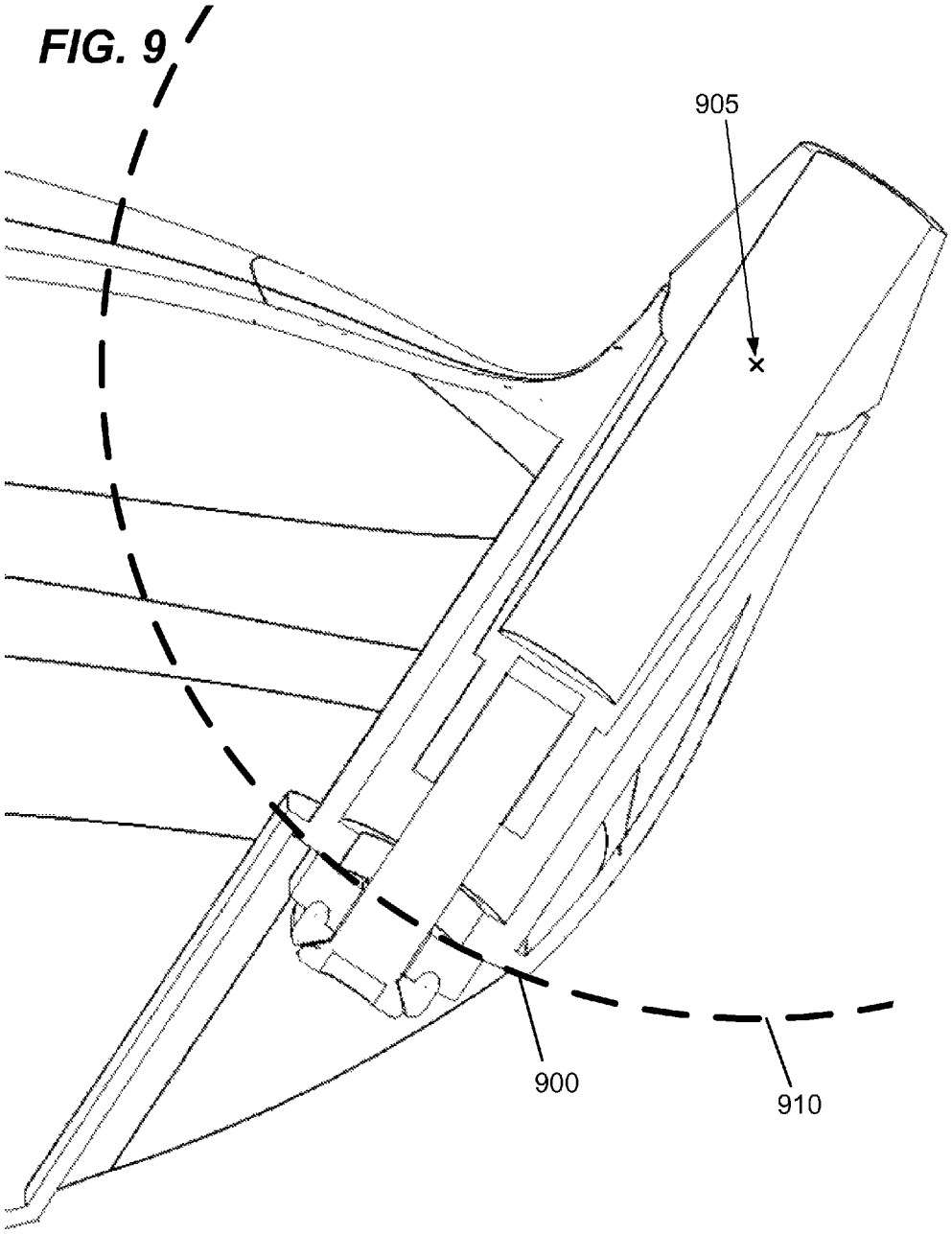
FIG. 9 depicts a cross-section of an adjustable golf club with a cross-section of a sphere shown for reference, in accordance with some embodiments of the present invention.

As shown in FIG. 9, embodiments of the present invention can further comprise a substantially spherical rim 900 that the one or more sliders 600, 700 can engage. In a preferred embodiment, the spherical rim 900 has its origin 905 at or proximate the center of rotation of the shaft 325, i.e., the point about which the shaft 325 pivots when being adjusted. As used herein, the term "spherical" includes a shape corresponding to a section of the surface of a sphere, such as the surface of a sphere cap. For illustration, FIG. 9 includes a dashed cross-section of a sphere 910 with its origin at the center of rotation 905.

In some embodiments, the spherical shape of the rim 900 can cause the force applied by the sliders 600, 700 to be axial with respect to the rim 900. This can cause the sliders 600, 700 to seat cleanly on the rim 900, reducing or eliminating the tendency of the sliders 600, 700 to become misaligned or improperly positioned after an adjustment. Without the spherical shape, for example, the tension force applied to the sliders 600, 700 could be at a non-normal angle to the rim 900, causing the sliders 600, 700 to move out of position. The spherical shape, however, can ensure that the tension force is normal to the rim 900 (and normal to the adaptor 800 and the shaft 325), and can enable the sliders 600, 700 to be positioned in a variety of configurations and then tightened in place. The normal tension force can also help "squeeze" the shaft 325 and club head 300 together, enabling the adjustable club to be as rigid as possible.

In some embodiments, the top surface 605 of the first slider 600 can also be substantially spherically shaped to match the contour of the rim 900. The spherically shaped top surface 605 can enable the first slider 600 to seat cleanly against the rim 900. This, in turn, can ensure that the force exerted by the fastener 405 on the first slider 600, and the first slider 600 on the rim 900, is normal to the rim 900. The normal force can prevent the club from "unadjusting," as described below.

Additionally, in some embodiments, the second slider 700 can also be substantially spherically shaped. This can enable the first slider 600 to seat cleanly against the rim 900 and the second slider 700 to seat cleanly against the first slider 600. This configuration can enable the sliders 600, 700 to slide effectively with respect to the rim 900 and with respect to each other, and can ensure that the force exerted on each of the sliders 600, 700 and the rim 900 by the fastener 405 is normal to the rim 900.

In some embodiments, in order to further prevent the sliders 600, 700 from becoming misaligned or improperly positioned, the rim 900 and/or the sliders 600, 700 can comprise textured surfaces. The bottom surface of the rim 900, the top 605 and bottom 610 surfaces of the first slider 600, and the top surface 705 of the second slider 700, for example, can comprise a rough texture. The rough texture can increase the frictional force between these components, reducing the probability that the sliders 600, 700 will move out of position.

As shown in FIG. 4, in some embodiments, a cavity 400 can be disposed within the club head 300. In some embodiments, as shown, the cavity 400 can be disposed within the hosel 305 of the club head 300. The cavity 400 can have an open top end configured to receive an adaptor 800. In some embodiments, the cavity 400 can be substantially cylindrically shaped, and can extend down through the hosel 305. The cavity 400 can also have a bottom surface comprising a substantially spherical rim 900. In some embodiments, the cavity 400 can comprise a hosel axis 430 that runs through the center of the cavity 400.

In some embodiments, the adaptor 800 can be a mechanical connector, or interface, between the shaft 325 and the club head 300. The adaptor 800 can attach the shaft 325 to the club head 300, and can enable the shaft 325 and club head 300 to pivot with respect to one another. Thus, the adaptor 800 can engage, or attach to, the shaft 325 and the club head 300. In a preferred embodiment, the adaptor 800 enables the shaft 325 and club head 300 to pivot so that loft and lie can be independently adjusted.

Figure 8:
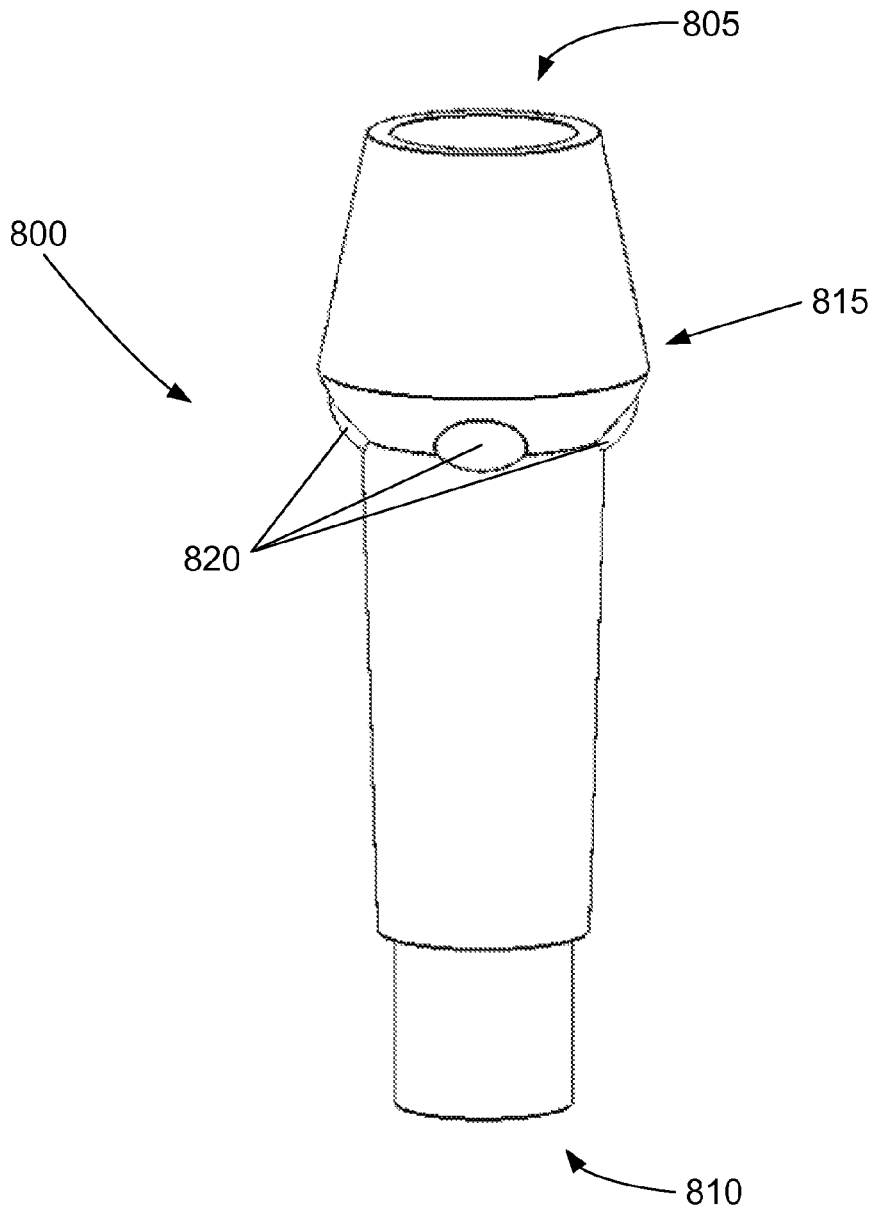
FIG. 8 depicts an adaptor for use with an adjustable golf club, in accordance with some embodiments of the present invention.

In some embodiments, the adaptor 800 can be disposed at least partially within the cavity 400 of the hosel 305 of the club head 300. As shown in FIG. 8, the adaptor 800 can have an upper portion 805 and a lower portion 810. The upper portion 805 of the adaptor 800 can be hollow, and can receive the shaft 325 of the golf club. In some embodiments, the shaft 325 can be secured inside the upper portion of the adaptor 800, and, in other embodiments, the adaptor 800 can be secured inside the lower portion of the shaft 325. The shaft 325 and adaptor 800 can be secured together by several means known in the art. The shaft 325 can be, for example and not limitation, glued or threaded into or around the upper portion 805 of the adaptor 800. In one embodiment, the shaft 325 is secured in the upper portion 805 of the adaptor 800 by a bolt.

In some embodiments, the lower portion 810 of the adaptor 800 can be disposed at least partially within the cavity 400 of the hosel 305. The lower portion 810 of the adaptor 800 can also couple to a fastener, such as a mechanical fastener 405. The mechanical fastener 405 can, in turn, couple to both the adaptor 800 and one or more sliders 600, 700. More specifically, the mechanical fastener 405 can be inserted through holes 620, 720 in the sliders 600, 700. Thus, the mechanical fastener 405 and the adaptor 800 can connect, or place into mechanical communication, the shaft 325, the club head 300, and the sliders 600, 700. In some embodiments, the mechanical fastener 405 can be a screw, bolt, pin, rod, shaft 325, rivet, stud, or other suitable component. In a preferred embodiment, the mechanical fastener 405 is a screw or bolt comprising threads. In some embodiments, the lower portion 810 of the adaptor 800 or shaft 325 can also comprise threads that engage the threads on the mechanical fastener 405.

As previously described, the golf club of the present invention can be adjusted by pivoting the club head 300 with respect to the shaft 325. In some embodiments, the shaft 325 can be disposed within the upper portion 805 of the adaptor 800, and the adaptor 800 can be disposed at least partially within the hosel 305. The adaptor 800 and the hosel 305 can therefore pivot with respect to one-another at a joint 410. The joint 410 can enable the adaptor 800, and thus the shaft 325, to pivot in the X and Y directions with respect to the club head 300.

In some embodiments, at the joint 410, the hosel 305 can comprise a receiving portion 415 for receiving an expanded portion 815 of the adaptor 800. In some embodiments, the receiving portion 415 of the hosel 305 and the expanded portion 815 of the adaptor 800 can comprise a complementary bearing joint, ball-and-socket joint 410, or lands and grooves. The joint 410 can enable the adaptor 800, and thus the shaft 325, to pivot in both the X-direction and the Y-direction, allowing loft and lie to be independently adjusted.

In some embodiments, the joint 410 can be configured to prevent the shaft 325 from rotating relative to the club head 300. As discussed above, this can prevent the markings on the grip, or an asymmetric grip, for example, from becoming misaligned with the club head 300. In order to prevent rotation, for example, the expanded portion 815 of the adaptor 800 can comprise one or more protrusions 820, and the receiving portion 415 can comprise one or more depressions 420 or grooves. The protrusions 820 can engage the depressions 420, thereby partially constraining the adaptor 800, and preventing the shaft 325 from rotating with respect to the club head 300. Moreover, the protrusions 820 and depressions 420 can be rounded to ensure that they do not limit adjustability of the loft or lie by limiting movement of the adaptor 800.

Embodiments of the present invention can also comprise a tapered adaptor 800. The adaptor 800 can be tapered, for example, such that the upper portion 805 of the adaptor 800 can be larger than the lower portion 810. In some embodiments, therefore, the upper portion 805 of the adaptor 800 can have a larger diameter than the lower portion 810. In some embodiments, the tapered shape of the adaptor 800 can prevent the lower portion 810 from contacting the sidewalls of the cavity 400 as the club head 300 is adjusted. The tapered shape can therefore prevent the adaptor 800 from liming the range of adjustability of the club.

In some embodiments, the mechanical fastener 405 can extend through the rim 900 of the cavity 400 and engage the adaptor 800. In a preferred embodiment, the head of the mechanical fastener 405 engages two sliders 600, 700 and the adaptor 800, thereby placing the sliders 600, 700 into mechanical communication with the shaft 325 and club head 300. In some embodiments, the mechanical fastener 405 can extend through the rim 900 of the cavity 400 and engage the adaptor 800 and the shaft 325.

In some embodiments, to adjust the club, the mechanical fastener 405 can be loosened, such that the tension force exerted by the fastener 405 on the sliders 600, 700 is reduced. This reduction in force can enable the sliders 600, 700 to move, which can enable a user to easily adjust the club. After the club is adjusted, the user can tighten the fastener 405, thereby increasing the tension force exerted by the fastener 405 on the sliders 600, 700, to frictionally prevent the sliders 600, 700 from moving. In some embodiments, a user can access the head of the mechanical fastener 405, and the sliders 600, 700, through an opening 425 located proximate the heel 310 of the club head 300.

In some embodiments, the sliders 600, 700 can comprise holes or slots that receive the mechanical fastener 405. The holes or slots can be shaped to provide an enhanced range of adjustability for the golf club. The hole 620 in the first slider 600, for example, can be substantially oval shaped. An oval shaped hole 620 can constrain the mechanical fastener 405 in a first direction, while allowing the mechanical fastener 405 to move in a second direction. In some embodiments, therefore, this configuration can constrain the mechanical fastener 405 in a direction parallel to the first slider's 600 movement, but not constrain movement parallel to the second slider's 700 movement. Thus, the mechanical fastener 405 can move with the second slider 700 even when it is partially constrained by the first slider 600. Likewise, the second slider 700 can also comprise a hole 720 to receive the mechanical fastener 405.

Embodiments of the present invention can enable varying degrees of adjustability of the golf club. This can be advantageous because the governing bodies of golf sometimes restrict the adjustability of golf clubs. In the case of golf rounds played in competition or for an official handicap, for example, the club cannot be "infinitely adjustable." This is because, if the club's setting is accidentally lost, it is likely not practical to return the club to its exact original setting, as sometimes required by the rules of golf. This means that, in some embodiments, it can be preferable that the club is not adjustable to an infinite degree, and instead has finite, discrete positions and orientations for adjustment. This ensures that if a club becomes "unadjusted" during competition, i.e., the club head 300 moves relative to the shaft 325, the club can be returned to its original position.

As discussed above, embodiments of the present invention can comprise a club with stepwise adjustability. These embodiments can comprise a discrete number of possible positions or orientations for the shaft 325 relative to the club head 300. In these configurations, the first slider 600 can engage the rim 900 of the cavity 400 in a series of distinct locations. The rim of the cavity 400 and the top surface 605 of the first slider 600 can comprise, for example and not limitation, teeth, fins, or grooves. The teeth can interlock, providing a pre-determined number of locations for the first slider 600 relative to the rim 900. This, in turn, provides a pre-determined number of locations for the shaft 325 relative to the club head 300 in a first direction, thereby limiting the adjustability of the club in that direction (i.e., the X-direction). In some embodiments, the teeth can be located, for example, on the ribs 500 of the rim and in the grooves 615 of the first slider 600.

In addition, in some embodiments, the second slider 700 can engage the first slider 600 in a series of distinct locations. Similar to the configuration described above, the bottom surface 610 of the first slider 600 and the top surface 705 of the second slider 700 can comprise complementary teeth. The teeth on the two sliders 600, 700 can interlock, providing a pre-determined number of positions for the second slider 700 relative to the first slider 600. As described above, this can provide a limited number of locations for the shaft 325 relative to the club head 300 in a second direction (i.e., the Y-direction), and can therefore enable the club to have stepwise adjustability on one or more directions, as opposed to infinite adjustability. In some embodiments, the teeth can be located, for example, on the ribs 715 of the second slider 700 and in the grooves 615 of the first slider 600.

In some embodiments, configurations other than complementary teeth can be used to achieve finite or stepwise adjustability. In some embodiments, for example, the sliders 600, 700 and rim 900 can comprise pins and holes. The pins and holes can engage one-another in pre-determined locations, providing stepwise adjustability of the golf club.

While in some embodiments the golf club can have stepwise adjustability, in other embodiments the golf club can be infinitely adjustable. In infinitely adjustable configurations, for example, teeth and/or pins and holes are generally not used to restrict the position of the sliders 600, 700. Thus, the sliders 600, 700 can be moved into an almost limitless number of positions relative to the club head 300.

Regardless of the manner of adjustment, it may be desirable for a golfer to know the particular lie or loft angle to which the club is adjusted. It may also be desirable for a golfer to know the amount that the club has been adjusted relative to a "default" or "centered" position. The "default" or "centered" position can be the unadjusted, or "standard" position of the club.

Figure 10A:
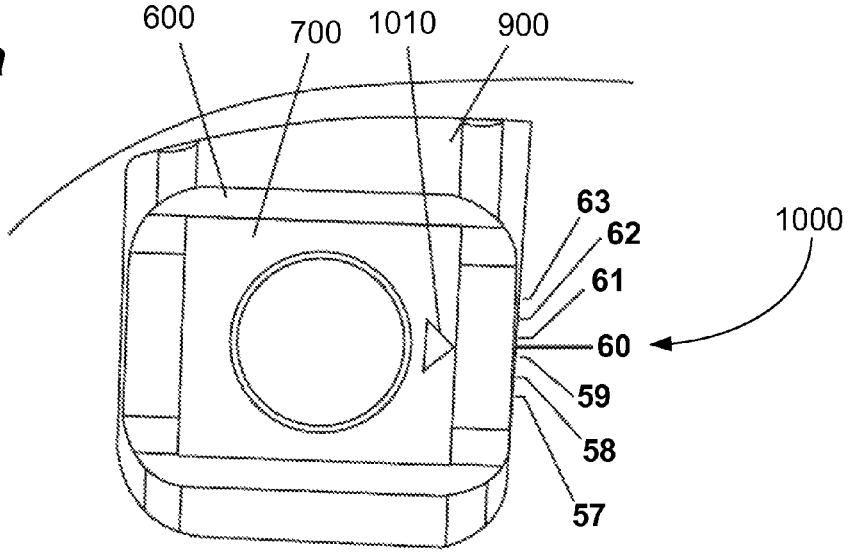
FIGS. 10*a*-10*b* depict bottom and side views, respectively, of an adjustable golf club with indicators and pointers for determining loft and lie, in accordance with some embodiments of the present invention.
Figure 10B:
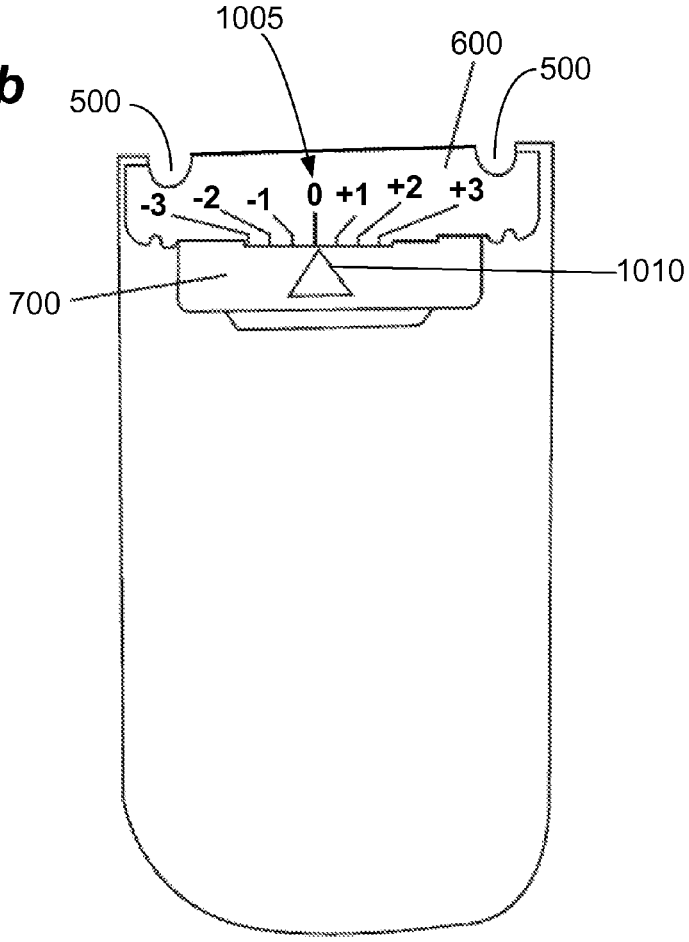

To provide this information, as shown in FIGS. 10*a*-10*b*, the rim 900 of the cavity 400, for example, or a location on or near the sliders 600, 700, can comprise lie indicators 1000 and loft indicators 1005. The lie indicators 1000 and loft indicators 1005 can be numbers, or scales, positioned on the club head 300 or the sliders 600, 700, and can correspond to lie and loft angles, respectively. In some embodiments, the lie and loft indicators 1000, 1005 can also indicate the difference between the lie and loft angle as currently adjusted and the default or centered lie and loft angle (e.g., + or – a number of degrees). In some embodiments, moreover, the sliders 600, 700 can comprise pointers 1010. In use, as the sliders 600, 700 move, the pointers 1010 can move with the sliders 600, 700 to indicate the adjustment of the club, i.e., the pointers 1010 can point to the current lie and loft angle by reference to the indicators 1000, 1005. In this manner, a golfer can refer to the pointers 1010 and the lie and loft indicators 1000, 1005 to determine the lie and loft angle of the club as currently adjusted.

In addition, many governing bodies that prohibit infinite adjustability do so to ensure that a golfer can restore his or her club to its original position if it becomes "unadjusted" during a round. Restoring the club to its original position, however, can be extremely difficult without lie and loft indicators 1000, 1005, because a golfer may not be able to determine the club's original and/or current position. Embodiments of the present invention, however, enable the golfer to reference the lie and loft indicators 1000, 1005 and pointers 1010 to note the starting position of the club and to ensure that the club can be repositioned properly.

Embodiments of the present invention can also provide varying amounts of adjustability to the club. Embodiments of the present invention can, therefore, enable the sliders 600, 700 to move a variety of distances. In some embodiments, for example, each slider can move in a range between about 0.5 mm and about 10 mm forward and backward from a default or centered position. In preferred embodiments, each slider can move approximately 2.5 mm forward and backward from its default or centered position. Depending on club specifications, 2.5 mm of movement generally corresponds to approximately 3.5 degrees of change in loft or lie. Accordingly, in some embodiments, each 0.5 mm of movement of a slider can correspond to a 0.7 degree change in loft or lie. Of course, the amount of change is dependent on shaft 325 and head 300 geometries, among other variables, and can vary widely.

The components of the present invention can be made from a variety of materials. The adaptor 800 and sliders 600, 700, for example, can comprise various metals or plastics. In some embodiments, the components can comprise, for example and not limitation, thermoplastics such as polyethylene, polypropylene, polystyrene, polyvinyl chloride, and polytetrafluoroethylene. In other embodiments, the components can comprise metals such as aluminum, aluminum alloys, steel, and magnesium. The components can also comprise composite materials. In a preferred embodiment, the adaptor 800 and sliders 600, 700 can comprise aluminum.

Figure 11:
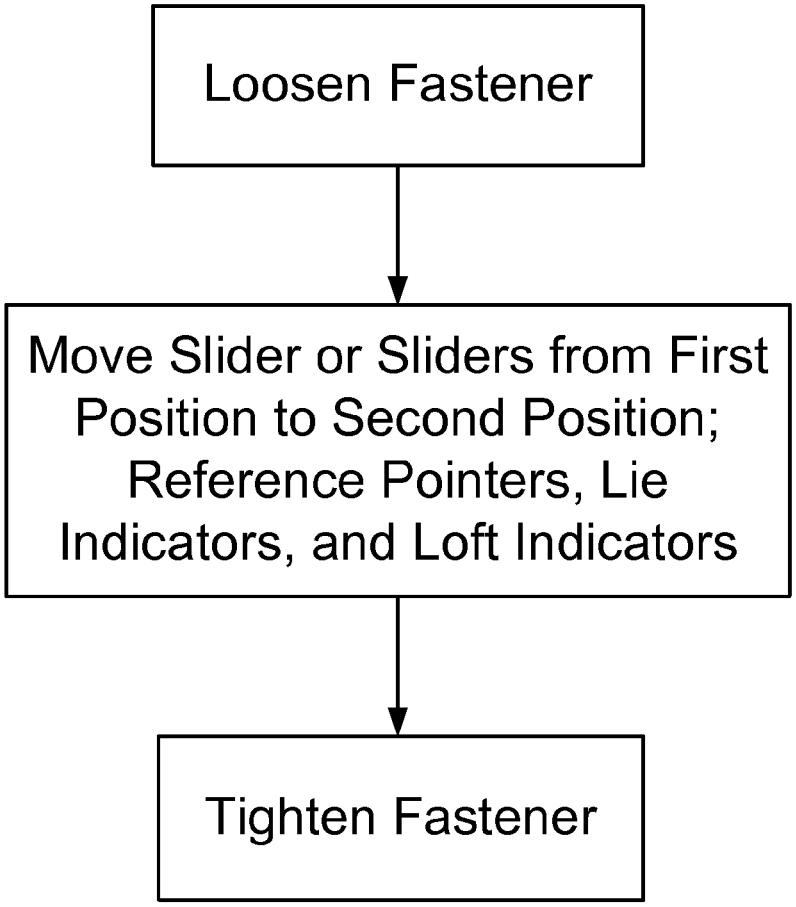
FIG. 11 is a flow chart depicting a method of adjusting a golf club, in accordance with some embodiments of the present invention.

Embodiments of the present invention can also comprise methods of adjusting a golf club, such as the methods described throughout this disclosure. As shown in FIG. 11, a method of adjusting a golf club can comprise loosening a fastener 405, such as a mechanical fastener 405, to enable one or more sliders 600, 700 to be moved from a first position to a second position. The one or more sliders 600, 700 can then be moved from a first position to a second position. In some embodiments, a first slider 600 can be moved from a first position to a second position, and a second slider can be moved from a first position to a second position. As described throughout this disclosure, this can adjust the orientation of the club head 300 with respect to the shaft 325. Specifically, this can adjust the lie and loft and the golf club. During this process, the pointers 1010, lie indicators 1000, and loft indicators 1005 can be referenced to determine the adjustment of the club, i.e., ensure that the club is being adjusted the desired amount or to the desired lie and loft angles. The fastener 405 can then be tightened to frictionally prevent the one or more sliders 600, 700 from moving, thereby preventing the club head 300 from moving with respect to the shaft 325, until the fastener 405 is loosened again.

While several possible embodiments are disclosed above, embodiments of the present invention are not so limited. For instance, while several possible configurations have been disclosed (e.g., embodiments with a plurality of sliders and teeth), other suitable materials and configurations could be selected without departing from the spirit of embodiments of the invention. In addition, the location and configuration used for various features of embodiments of the present invention can be varied according to a particular golf club that requires a slight variation due to, for example, the size or construction of the golf club. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. An adjustable golf club comprising:

a club head;

a shaft pivotably connected to a hosel portion of the club head with a fastener;

one or more sliders disposed between the fastener and the club head, and moveable to adjust the orientation of the club head with respect to the shaft, the one or more sliders comprising:

a first slider and a second slider;

wherein moving the first slider effects a change in the loft angle; and wherein moving the second slider effects a change in the lie angle;

wherein each of the one or more sliders effects a change in one of a loft angle of the club and a lie angle or the club without impacting the other one of the loft angle of the club and the lie angle of the club.

2. The adjustable golf club of claim 1, wherein the first slider and the second slider are constrained to move in substantially orthogonal directions.

3. The adjustable golf club of claim 2, wherein the first slider and the second slider are constrained by ribs and grooves.

4. The adjustable golf club of claim 1, further comprising an adaptor that engages the shaft and the hosel portion of the club head, the adaptor configured to pivot with the shaft when the position of the one or more sliders is adjusted.

5. The adjustable golf club of claim 4, wherein the adaptor is at least partially disposed within a cavity of the hosel portion of the club head.

6. The adjustable golf club of claim 4, the adaptor comprising one or more protrusions and the club head comprising one or more depressions, at least one protrusion configured to engage at least one depression to prevent the shaft from rotating relative to the club head.

7. The adjustable golf club of claim 1, wherein the fastener can be loosened to enable movement of the first slider and wherein the fastener can be tightened to prevent the first slider from moving.

8. The adjustable golf club of claim 1, wherein the adjustability of the one or more sliders is limited to a discrete number of orientations.

9. The adjustable golf club of claim 1, further comprising lie indicators, loft indicators, and pointers configured such that the pointers point to the lie indicators and loft indicators to indicate the adjustment of the golf club.

10. An adjustable golf club comprising:

a club head;

a shaft pivotably connected to a hosel portion of the club head with a fastener;

one or more sliders disposed between the fastener and the club head, and moveable to adjust the orientation of the club head with respect to the shaft;

wherein each of the one or more sliders effects a change in one of a loft angle of the club and a lie angle or the club without impacting the other one of the loft angle of the club and the lie angle of the club; and wherein a first slider of the one or more sliders abuts a substantially spherical rim of the golf club head.

11. The adjustable golf club of claim 10, wherein the shaft pivots about a point that is the origin of the curve formed by the substantially spherical rim.

12. The adjustable golf club of claim 10, further comprising an adaptor that engages the shaft and the hosel portion of the club head, the adaptor configured to pivot with the shaft when the position of the one or more sliders is adjusted.

13. The adjustable golf club of claim 12, wherein the adaptor is at least partially disposed within a cavity of the hosel portion of the club head.

14. The adjustable golf club of claim 12, the adaptor comprising one or more protrusions and the club head comprising one or more depressions, at least one protrusion configured to engage at least one depression to prevent the shaft from rotating relative to the club head.

15. The adjustable golf club of claim 10, wherein the fastener can be loosened to enable movement of the first slider and wherein the fastener can be tightened to prevent the first slider from moving.

16. The adjustable golf club of claim 10, wherein the adjustability of the one or more sliders is limited to a discrete number of orientations.

17. The adjustable golf club of claim 10, further comprising lie indicators, loft indicators, and pointers configured such that the pointers point to the lie indicators and loft indicators to indicate the adjustment of the golf club.

18. An adjustable golf club comprising:

a club head;

a shaft connected to a hosel portion of the club head with a fastener; and a first slider positioned between the fastener and the club head, constrained to move in a first direction;

a second slider positioned between the fastener and the club head, constrained to move in a second direction, the first direction being substantially orthogonal to the second direction; and the first and second sliders in mechanical communication with the club head and the shaft to adjust the lie and loft of the golf club.

19. The adjustable golf club of claim 18, wherein moving the first slider in the first direction adjusts the lie of the golf club and moving the second slider in the second direction adjusts the loft of the golf club.

20. The adjustable golf club of claim 18, wherein the lie can be adjusted without changing the loft, and the loft can be adjusted without changing the lie.

* * * * *